United States Patent [19]

Grist

[11] 4,100,688

[45] Jul. 18, 1978

[54] EARTH WORKING APPARATUS

[75] Inventor: Warren W. Grist, Universal City, Tex.

[73] Assignee: Earth Pack, Inc., San Antonio, Tex.

[21] Appl. No.: 715,667

[22] Filed: Aug. 19, 1976

[51] Int. Cl.[2] ..... A01B 29/04; B66F 9/00; E01C 19/00

[52] U.S. Cl. ..... 37/117.5; 37/DIG. 3; 214/145 A; 214/DIG. 5; 404/127; 404/128; 172/254; 172/272

[58] Field of Search ..... 37/103, 117.5, DIG. 3, 37/141, 142.5; 172/272, 554, 547, 464, 254; 214/145 R, 145 A, DIG. 5; 404/128, 127, 121

[56] References Cited

U.S. PATENT DOCUMENTS

| | | | |
|---|---|---|---|
| 2,003,186 | 5/1935 | Glassner | 404/128 X |
| 2,755,092 | 7/1956 | Donahoe | 37/DIG. 3 |
| 3,146,686 | 9/1964 | Grace et al. | 404/127 |
| 3,217,620 | 11/1965 | Mindrum et al. | 404/128 X |
| 3,481,056 | 12/1969 | Meade et al. | 37/117.5 |
| 3,595,411 | 7/1971 | Ables | 37/103 X |
| 3,680,452 | 8/1972 | Mangum | 404/128 X |
| 3,834,566 | 9/1974 | Hilfiker | 214/145 X |
| 3,845,796 | 11/1974 | Moore | 37/141 X |
| 3,874,533 | 4/1975 | Montgomery | 214/145 A |
| 3,891,342 | 6/1975 | Roe | 37/103 X |
| 3,893,517 | 7/1975 | Norvell | 214/145 X |
| 3,934,738 | 1/1976 | Arnold | 214/145 A |
| 3,989,404 | 11/1976 | Burton | 404/128 |
| 3,997,068 | 12/1976 | Lock | 37/103 |

FOREIGN PATENT DOCUMENTS

| | | | |
|---|---|---|---|
| 252,491 | 5/1963 | Australia | 37/103 |
| 262,510 | 10/1964 | Australia | 37/DIG. 3 |
| 2,513,772 | 3/1975 | Fed. Rep. of Germany | 214/145 A |
| 1,456,538 | 1/1969 | Fed. Rep. of Germany | 214/145 A |

*Primary Examiner*—E. H. Eickholt
*Attorney, Agent, or Firm*—John L. Cline

[57] ABSTRACT

An earth working apparatus is disclosed including means for removably coupling a compacting roller into operative engagement with a hydraulically manipulated boom while simultaneously maintaining the excavating bucket of the apparatus in its operative association with the boom. The coupling means includes a specially designed link which connects the hydraulic means of the boom to the bucket and which is adapted to receive and engage the compacting roller upon upward movement of the boom.

6 Claims, 6 Drawing Figures

EARTH WORKING APPARATUS

BACKGROUND OF THE INVENTION

The present invention relates generally to earth working equipment and, more specifically, to earth excavating and compacting apparatus. In particular, the present invention is directed to apparatus wherein a compacting roller, such as sheep's foot roller, may be expeditiously mounted or removed from the conventional bucket and boom assembly of such earth moving equipment.

Several prior art apparatus have been developed which allow the use of either an excavating bucket or a compacting roller on a single boom. Although such apparatus have met with some success, they have failed to be completely satisfactory. For example, U.S. Pat. No. 3,891,342 discloses an arrangement wherein the excavating bucket must be removed from the backhoe in order to mount the compacting roller. This is a time consuming operation, and is especially undesirable in situations wherein both the bucket and roller are to be used repeatedly during a single excavation project. U.S. Pat. No. 3,595,411 discloses a similar apparatus wherein the compacting roller is mounted directly onto the back of the excavating bucket. This arrangement requires that the bucket be modified to some extent. In addition, mounting of the roller requires accurate alignment of the bucket and roller which may be difficult in many instances.

SUMMARY OF THE INVENTION

The present invention is directed to an improved earth excavating and compacting apparatus wherein both an excavating bucket and a compacting roller are mounted in operative engagement with a hydraulically manipulated boom. In addition, the roller may be easily removed and then remounted onto the boom without the need for manual alignment of the respective components.

In accordance with the present invention, the compacting roller may be removably coupled to the boom of a backhoe while simultaneously maintaining the backhoe bucket in operative engagement on the boom. This is accomplished by the employment of a specially designed mechanical linkage which allows both the bucket and roller to be operatively engaged to the boom but which also allows the expeditiuns removal and remounting of the roller where working conditions require.

BRIEF DESCRIPTION OF THE DRAWINGS

The novel features which are believed to be characteristic of the invention are set forth in the appended claims. The invention itself, however, together with further objects and attendant advantages thereof, will be best understood by reference to the following description taken in connection with the accompanying drawings in which:

DETAILED DESCRIPTION OF THE INVENTION

Figure 1:
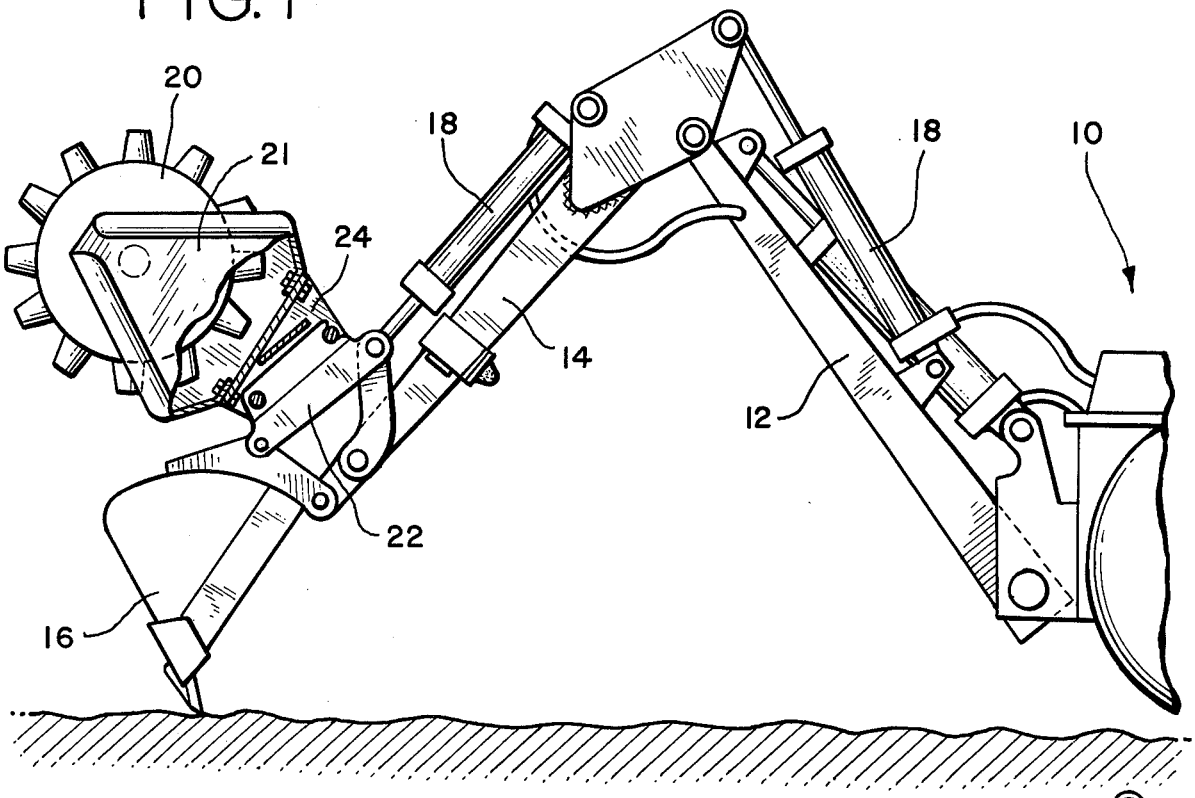
FIG. 1 is a side elevation illustrating the improved earth excavating and compacting apparatus of the present invention positioned to perform an excavation operation.
Figure 2:
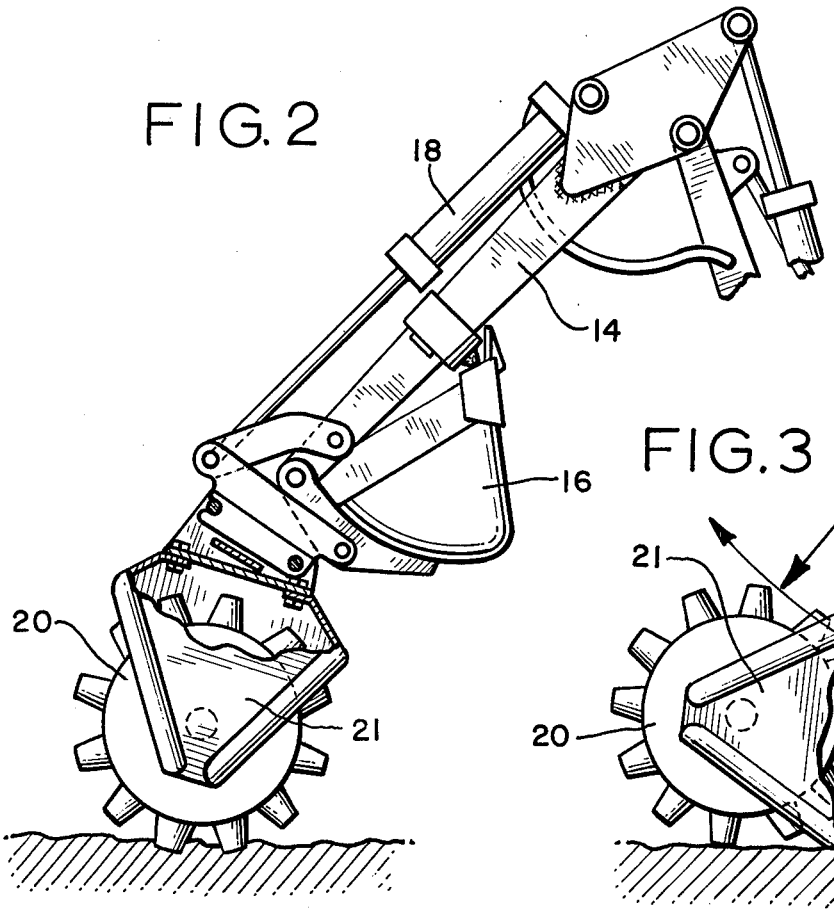
FIG. 2 is another side elevation depicting the apparatus of FIG. 1 in position to perform a compacting operation.
Figure 3:
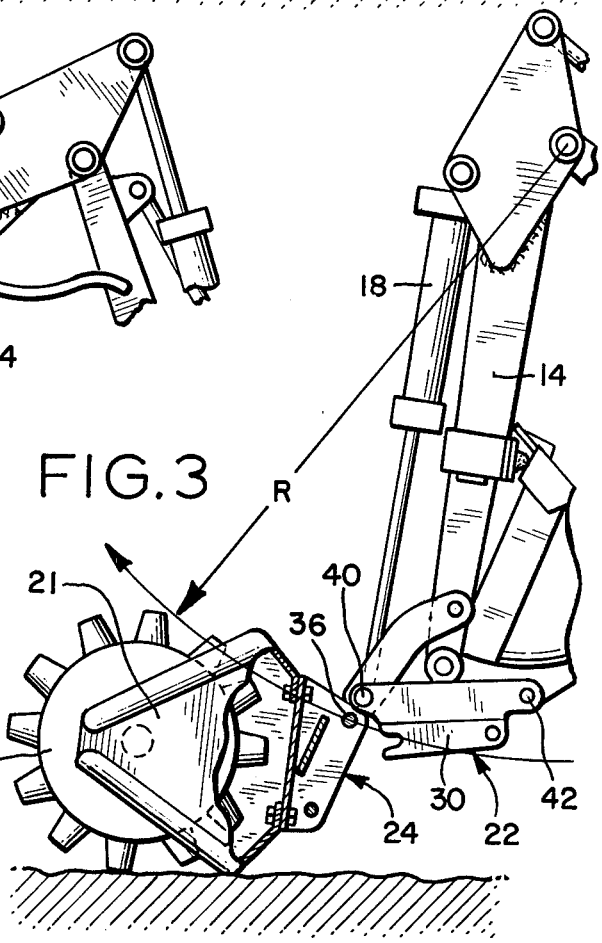
FIG. 3 is a side elevation illustrating the method of mounting the compacting roller to the bucket and boom of the apparatus.

Referring to FIGS. 1 through 3, a conventional backhoe, designated generally as 10, is illustrated having a bifurcated boom with arms 12 and 14 and an excavating bucket 16. The backhoe 10 also includes a hydraulic assembly comprised of a series of hydraulic cylinders 18 which are used to manipulate the boom and bucket in the various earth moving operations.

In accordance with the present invention, a compacting roller 20 may be removably coupled into operative engagement with the backhoe boom while simultaneously maintaining the excavating bucket 16 in operative engagement with the boom.

As can be clearly seen in FIG. 1, the compacting roller 20 is mounted on the backhoe in a manner such that it interferes only minimally with the excavating and back filling operations of the bucket 16. Similarly, FIG. 2 illustrates that the mounting assembly is also arranged such that the bucket 16 does not interfere with the proper compacting operations performed by the roller 20.

One of the principal objects of the present invention is to provide a coupling assembly for the compacting roller 20 such that it may be expeditiously mounted and removed from the boom of the backhoe 10. This is accomplished by providing a specially designed link member 22 which connects the bucket 16 with the hydraulic assembly of the backhoe and which includes means for receiving and engaging a mounting bracket 24 of the compacting roller 20 upon an upward movement of the backhoe boom.

Figure 4:
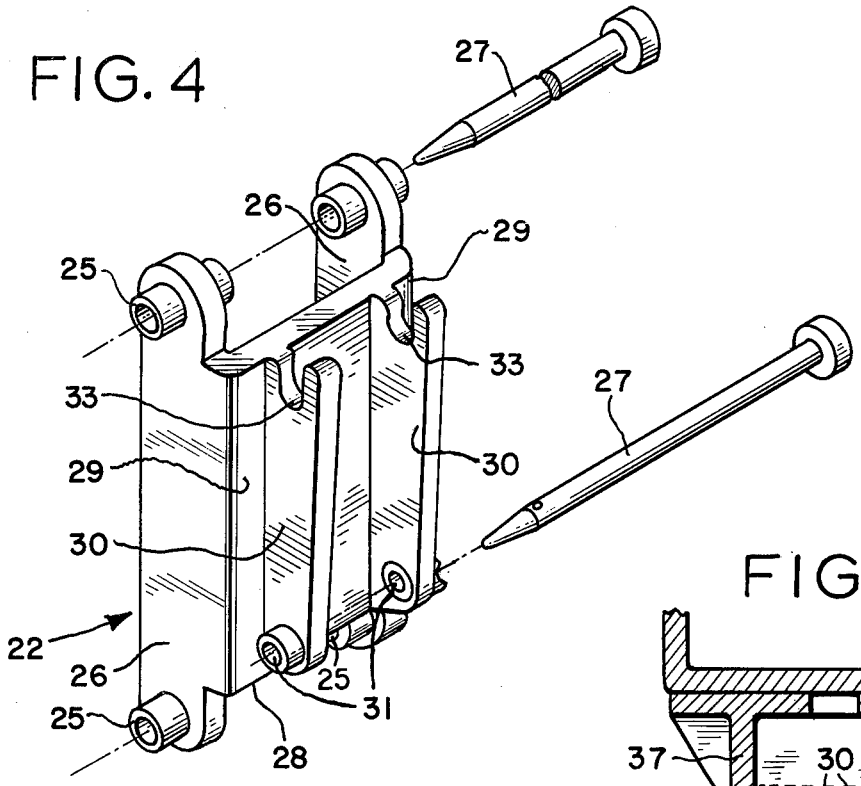
FIG. 4 is an exploded perspective view showing in greater detail a preferred embodiment of the mechanical linkage employed in the practice of the present invention.
Figure 6:
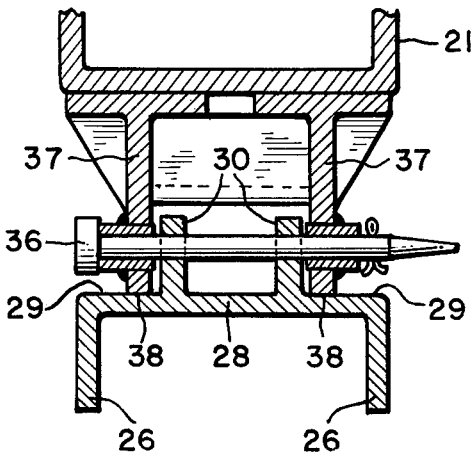
FIG. 6 is a cross-sectional view taken along line 6—6 of FIG. 5.
Figure 5:
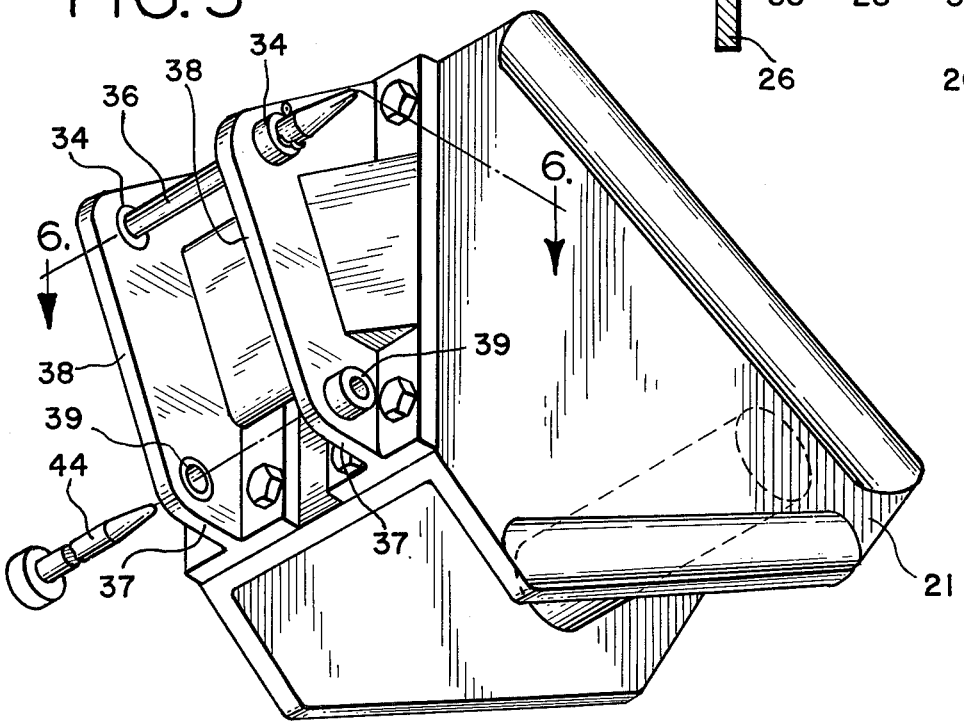
FIG. 5 is also an exploded perspective view illustrating in greater detail a preferred embodiment of the mounting bracket utilized in the practice of the present invention.

Referring now to FIGS. 4 through 6, a preferred embodiment of the coupling assembly is illustrated. FIG. 4 illustrates in greater detail the link member 22 which includes a pair of elongated struts 26 joined by a transverse plate 28. A pair of receiving elements 30 are mounted on the surface of plate 28 in spaced and parallel relationship. Each of the struts 26 includes means at each end, such as holes 25 and pins 27, for pivotal connection of the link member 22 to the hydraulic system of the backhoe and the excavating bucket 16.

FIG. 5 illustrates in greater detail the mounting bracket 24 which is employed in the preferred embodiment to cooperate with link member 22 in mounting the compacting roller 20 to the backhoe. The mounting bracket 24, in accordance with this embodiment, includes a pair of spaced T-shaped channels which are suitably secured to the backface of the yoke 21 in which the compacting roller rotates. The channels 37 may be suitably reinforced in any manner well known in the art and include apertures 34 which form bearings for the transverse shaft 36.

FIG. 3 illustrates a method by which the apparatus of the present invention is employed to mount the compacting roller 20 to the backhoe 10. The link member 22 is pivotally connected at point 40 to the hydraulic cylinder 18 and at point 42 to the bucket 16. Means are provided in the receiving elements 30 for engaging the transverse shaft 36 upon rotation of boom arm 14 in the direction illustrated by the arrow. As is shown in FIG. 4, the engaging means of the preferred embodiment comprises a pair of notches or slots 33 or a bent plate spanning across 30 each positioned in the receiving elements 30 adjacent the end connected to the hydraulic cylinder assembly. As arm 14 moves upwardly the slots 33 will engage the shaft 36 and lift the yoke 21 of the compacting roller 20 to the point where the stop surfaces 38 of channels 37 abut with the stop surface 29 of plate 28. When stop surfaces 38 and 29 are joined, as is clearly seen in FIG. 6, the holes 31 of link member 22 and the holes 39 of mounting bracket 24 are automatically aligned such that the locking pin 44 may be easily inserted. In this way the mounting bracket 24 may be locked to the link member 22 thereby securing the compacting roller 20 in operative engagement with the backhoe 10. Of course, the compacting roller 20 may be easily removed from the backhoe 10 merely by reversing the sequence of steps discussed hereinabove.

It will be appreciated by those skilled in the art that the mounting and removal of the compacting roller may be accomplished by the backhoe operator in a most expeditious manner particularly in view of the structural arrangement whereby the mounting bracket 24 and link member 22 are automatically aligned to accept the locking means.

Of course, it should be understood that various changes and modifications to the preferred embodiments described herein will be apparent to those skilled in the art. For example, while the invention has been described in conjunction with a backhoe, it is readily apparent that it is equally adaptable to other earth excavating equipment utilizing a boom operated implement. In addition, tools other than the bucket and sheep's foot roller may be utilized in conjunction with the present invention. For example, an impacting tool may be provided with a mounting bracket and substituted for the roller.

Other modifications would include providing the receiving slots 33 of the link member 22 with an elongated channel which spans the space between the receiving elements 30; or the stop surfaces which provide for automatic alignment of the locking means may comprise components of the link member 22 and mounting bracket 24 other than stop surfaces 38 and 29 shown above. Such changes and modifications can be made without departing from the spirit and scope of the present invention and without diminishing its attendant advantages. It is, therefore, intended that such changes and modifications be covered by the following claims.

I claim:

1. In an earth excavating and compacting apparatus having a boom, an excavating bucket, a compacting roller and hydraulic means for manipulating said bucket and roller, the improvement comprising:

means for removably coupling said compacting roller into operative engagement with said boom including a link member connecting said bucket to said hydraulic means, means associated with said link member for receiving and engaging a mounting bracket of said bucket upon an upward movement of said boom, and means for locking said mounting bracket to said link member to secure said roller in operating position.

2. The improved earth excavating and compacting apparatus of claim 1 wherein said link member includes means for automatically aligning said locking means upon upward movement of said boom.

3. The improved earth excavating and compacting apparatus of claim 2 wherein said aligning means comprises complimentary surfaces on both said link member and said mounting bracket whereby the joining of said surfaces results in the alignment of said locking means.

4. The improved earth excavating and compacting apparatus of claim 3 wherein said link member receiving and engaging means comprises slot means which cooperates with a transverse rod on said mounting bracket whereby upon engagement of said slot and rod and further upward movement of said boom said bucket rotates into operating position on said link member.

5. An improved earth working apparatus, comprising:

a first earth working implement;

a second earth working implement;

a boom;

hydraulic means associated with said boom for working said implements; and means for removably coupling said second implement in operative engagement with said boom and said hydraulic means while simultaneously maintaining said first implement in operative engagement with said boom and said hydraulic means, said coupling means including a link member having one end pivotally connected to said hydraulic means and the other end pivotally connected to said first implement, said link member also having means adjacent said one end for receiving and engaging a mounting bracket of said second implement as said boom is raised.

6. An improved apparatus for excavating and compacting earth surface, which comprises:

coupling means;

an excavating bucket pivotally and directly mounted to said coupling means;

a compacting roller pivotally and directly mounted to said coupling means;

a boom pivotally mounted to said coupling means; and hydraulic means, operatively associated with said boom and acting directly on said coupling means, for placing one of the implements comprising the bucket and compacting roller in operating position while simultaneously maintaining the other implement in an inoperative position and for working the implement placed in the operating position, said hydraulic means being pivotally connected to said coupling means and said compacting roller being removably mounted to said coupling means.

* * * * *

UNITED STATES PATENT AND TRADEMARK OFFICE

CERTIFICATE OF CORRECTION

PATENT NO. : 4,100,688

DATED : July 18, 1978

INVENTOR(S) : Warren W. Grist

It is certified that error appears in the above-identified patent and that said Letters Patent are hereby corrected as shown below:

Column 1, line 9, before "sheep's" insert --a--;

Column 1, line 49, "expeditiuns" should be --expeditious--.

Signed and Sealed this

*Thirteenth* Day of *February 1979*

[SEAL]

*Attest:*

RUTH C. MASON
*Attesting Officer*

DONALD W. BANNER
*Commissioner of Patents and Trademarks*